United States Patent [19]

Davis et al.

[11] Patent Number: 4,749,099

[45] Date of Patent: Jun. 7, 1988

[54] DRINK PRESERVER

[76] Inventors: Arthur Davis, 178 Ludlow St. #1C, New York, N.Y. 10002; George Spector, 233 Broadway RM 3815, New York, N.Y. 10007

[21] Appl. No.: 115,381

[22] Filed: Nov. 2, 1987

[51] Int. Cl.[4] ..... B65D 41/32

[52] U.S. Cl. ..... 220/265; 220/1 BC; 222/561

[58] Field of Search ..... 220/265, 266, 267, 268, 220/269, 1 BC; 222/561

[56] References Cited

U.S. PATENT DOCUMENTS

| | | | |
|---|---|---|---|
| 2,304,214 | 12/1942 | Straub | 220/265 X |
| 3,363,798 | 1/1968 | Garangiotis | 222/561 X |
| 3,473,692 | 10/1969 | Moller | 220/265 |

*Primary Examiner*—Steven M. Pollard

[57] ABSTRACT

A reclosable container is provided and consists of a push-in tab interconnected to a slide panel within a track formed in the metal top of the container. The push-in tab operates to tear a scored portion down into the top for exposing an opening whereby the slide panel can be moved over the opening to protect unused contents within the container.

7 Claims, 1 Drawing Sheet

DRINK PRESERVER

BACKGROUND OF THE INVENTION

The instant invention relates generally to containers and more specifically it relates to a reclosable container.

Numerous containers have been provided in prior art that are adapted to be opened and resealed if the contents within the containers are not completely consumed. For example U.S. Pat. Nos. 4,164,303; 4,234,099 and 4,339,053 all are illustrative of such prior art. While these units may be suitable for the particular purpose to which they address, they would not be as suitable for the purposes of the present invention as heretofore described.

SUMMARY OF THE INVENTION

A primary object of the present invention is to provide a reclosable container that will overcome the shortcomings of the prior art devices.

Another object is to provide a reclosable container in that once opened can be resealed by a slide panel to protect the unused contents within the container.

An additional object is to provide a reclosable container that contains a push-in tab retained on the slide panel thus overcoming an environmental problem of littering.

A further object is to provide a reclosable container that is simple and easy to use.

A still further object is to provide a reclosable container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
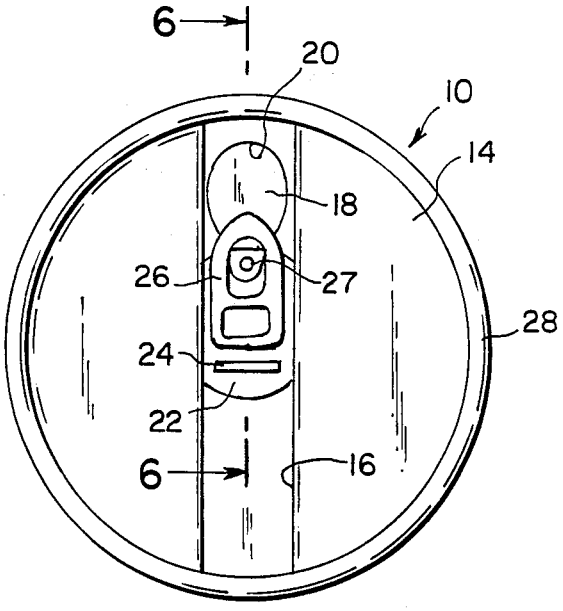
FIG. 1 is a top view of a container with invention thereon.
Figure 2:
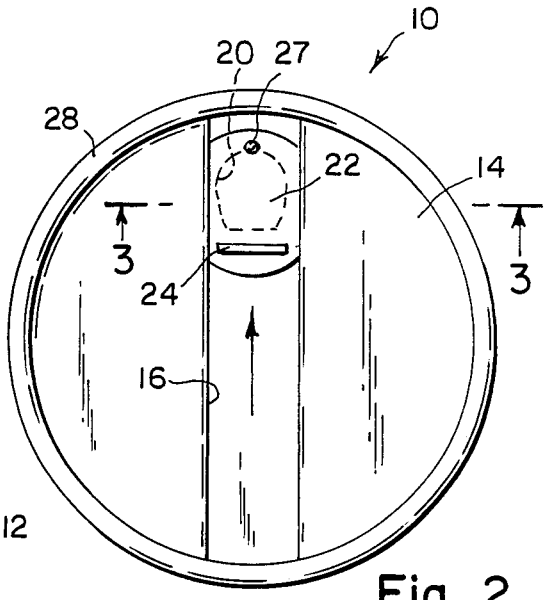
FIG. 2 is a top view of a container with slide panel sealing an opening in top of the container.
Figure 3:
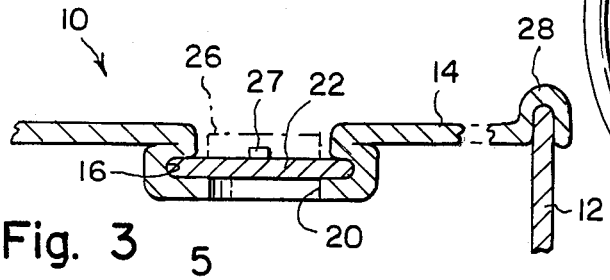
FIG. 3 is a cross sectional view taken along line 3—3 in FIG. 2 showing the track which is formed in the top of the container in greater detail.

Turning now descriptively to the drawings, in which similar reference characters denote similar elements throughout the several views, FIGS. 1 through 3 illustrates a reclosable container 10 consisting of a body 12 and a metal top 14 that has a track 16 integrally formed therein in wich the metal top 14 is joined to the body 12. A scored portion 18 is formed on the top 14 for outlining an opening 20 of generally oval shape that is located within bottom of the track 16 adjacent to an edge of the top 14. A slide panel 22 that has a handle 24 thereon can be manually moved within the track 16. A push-in tab 26 is interconnected to the slide panel 22 by a rivet 27, at an end thereof. The push-in tab 26 is operable to tear the scored portion 18 down into the top 14 for exposing the opening 20 and contents (not shown) of the container 10. The slide panel 22 can be moved over the opening 20 to protect the unused contents within the container 10.

The container includes a rim 28 in which the top 14 is recessed below upper edge of the rim 28 while the track 16 is recessed below upper surface of the top 14 to partially conceal the slide panel 22 and protect the push-in tab 26.

Figure 4:
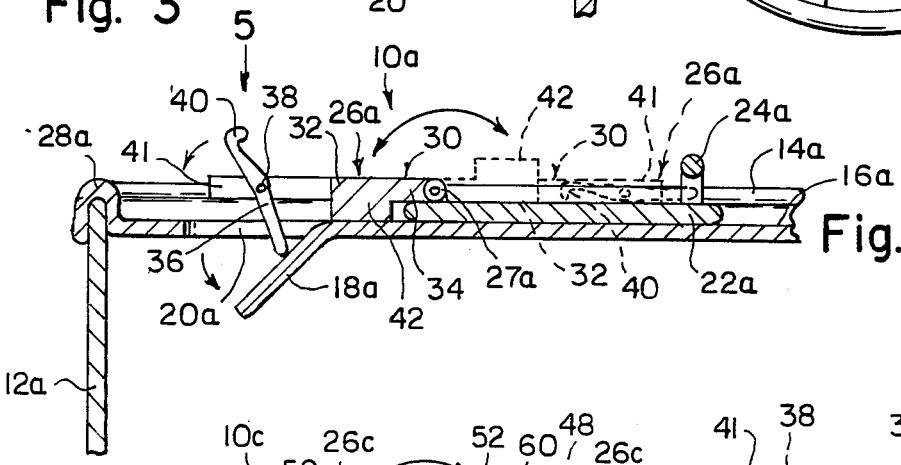
FIG. 4 is a cross sectional view of a modification in which a no litter opener pivotly stays on the slide panel.
Figure 5:
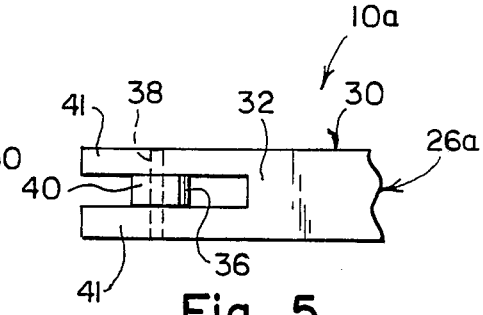
FIG. 5 is a top view taken in direction of arrow 5 in FIG. 4 showing the fork end of the arm in greater detail.

FIGS. 4 and 5 show another type of reclosable container **10*a* wherein the push-in tab 26*a* includes an arm 30 that has a forked end 32 and a hinged end 34, the arm 30 pivotly mounted at 27 to the slide panel 22*a*, at the hinged end 34. An opener 36 is pivotally mounted at 38 between the furcations 41 of the forked end 32. When the arm 30 is pivoted at the hinged end 34 to an extended position from the slide panel 22*a* the opener 36 can be pivoted to a position to be operable to tear the scored portion 18*a* down into the top 14*a***.

The opener 36 has a hooked grip portion 40 thereon so that the hooked grip portion can be grasped by a hand of a person (not shown) allowing the opener 36 to be pivoted to the operable position. The arm 30 has a thick support portion 42 so that when the arm 30 is pivoted to the extended position the thick support portion 42 can bear against bottom of the track **16*a* of the top 14*a* in front of the slide panel 22*a* to give the arm 30 proper leverage when the opener 36** is pivoted to the operable position.

Figure 6:
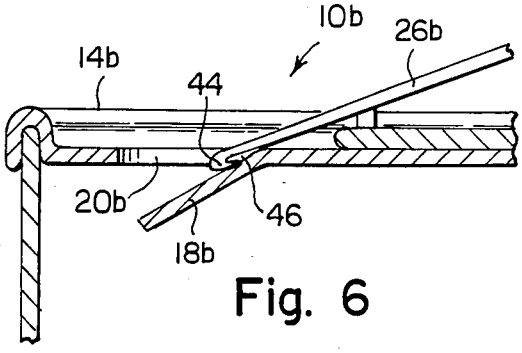
FIG. 6 is a cross sectional view taken along line 6—6 in FIG. 1, showing another modification in which the scored portion is retained by the push-in tab from falling into the container.

FIG. 6 shows yet another type of reclosable container **10*b* with a first hook 44 formed on forward end of the push-in tab 26*b* and a second hook 46 formed on top side of the scored portion 18*b*. When the push-in tab 26*b* tears the scored portion 18*b* down into the top 14*b* for exposing the opening 20*b* and the contents of the container 10*b*, the first hook 44 will engage with the second hook 46 to retain the scored portion 18*b* from dislodging and falling into the container 10*b***.

Figure 7:
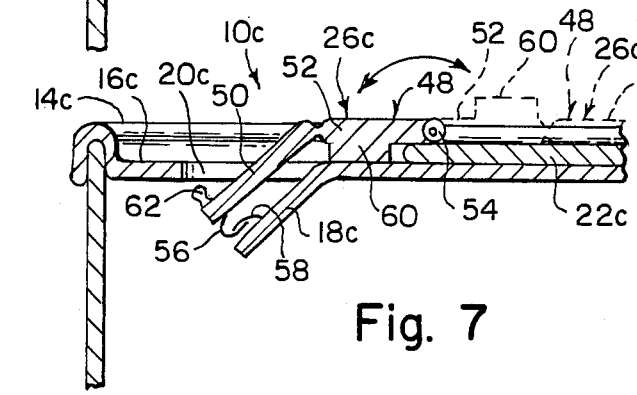
FIG. 7 is a cross sectional view similar to FIG. 4, of still another modification in which the second portion is retained by the opener arm after the scored portion is opened.

FIG. 7 shows still another type of reclosable container **10*c* wherein the push-in tab 26*c* includes an arm 48 that has a bendable forward end 50 and a hinged end 52. The arm 48 is pivotly mounted at 54 to the slide panel 22*c* at the hinged end 52 so that when the arm 48 is pivoted at the hinged end 52 to an extended position from the slide panel 22*c* the bendable forward end 50 can be pressed down to tear the scored portion 18*c* down into the top 14*c***.

A first hook 56 is formed on underside of the bendable forward end 50 and a second hook 58 is formed on top side of the second portion **18*c*. When the bendable forward end 50 of the arm 48 tears the scored portion 18*c* down into the top 14*c* the first hook 56 will engage with the second hook 58 to retain the scored portion 18*c* from dislidging and falling into the container 10*c***.

The arm 48 has a thick support portion 60 on the hinged end 52 adjacent the bendable forward end 50.

When the arm 48 is pivoted to the extended position, the thick support portion 60 can bear against bottom of the track 16c of the top 14c in front of the slide panel 22c to give the bendable forward end 50 proper leverage before the bendable forward end is pressed down to tear the scored portion 18c.

A finger grip 62 is formed on free edge of the bendable forward end 50 so that the bendable forward end of the arm 48 can be pulled up with the scored portion 18c interconnected thereto by the first and second hooks 56 and 58 for exposing the opening 20c and the contents of the container 10c.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A reclosable container which comprises:

(a) a body;

(b) a metal top having a track integrally formed therein, said metal top joined to said body;

(c) a scored portion formed on said top for outlining an opening of generally oval shape that is located within the bottom of said track adjacent to an edge of said top;

(d) a slide panel having a handle thereon so as to be manually moved within said track; and (e) a push-in tab interconnected to said slide panel at an end thereof, said push-in tab is operable to tear said scored portion down into said top for exposing said opening and contents of said container, whereby said slide panel can be moved over said opening to protect the unused contents within said container.

2. A reclosable container as recited in claim 1, in which said container includes a rim in which said top is recessed below upper edge of said rim and said track is recessed below upper surface of said top to partially conceal said slide panel and protect said push-in tab.

3. A reclosable container as recited in claim 2, wherein said push-in tab further includes:

(a) an arm having a forked end and a hinged end, said arm pivotly mounted to said slide panel at the hinged end; and (b) an opener pivotly mounted between the furcations of the forked end so that when said arm is pivoted at the hinged end to an extended position from said slide panel said opener can be pivoted to a position to be operable to tear said scored portion down into said top.

4. A reclosable container as recited in claim 3, further comprising:

(a) said opener having a hooked grip portion thereon so that said hooked grip portion can be grasped by a hand of a person allowing said opener to be pivoted to the operable position; and (b) said arm having a thick support portion so that when said arm is pivoted to the extended position said thick support portion can bear against bottom of said track of said top in front of said slide panel to give said arm proper leverage when said opener is pivoted to the operable position.

5. A reclosable container as recited in claim 2, further comprising:

(a) a first hook formed on forward end of said push-in tab; and (b) a second hook formed on top side of said scored portion so that when said push-in tab tears said scored portion down into said top for exposing said opening and the contents of said container, said first hook will engage with said second hook to retain said scored portion from dislodging and falling into said container.

6. A reclosable container as recited in claim 2, wherein said push-in tab further includes:

(a) an arm having a bendable forward end and a hinged end, said arm pivotly mounted to said slide panel at the hinged end so that when said arm is pivoted at the hinged end to an extended position from said slide panel, said bendable forward end can be pressed down to tear said scored portion down into said top;

(b) a first hook formed on underside of said bendable forward end; and (c) a second hook formed on top side of said scored portion so that when said bendable forward end of said arm tears said scored portion down into said top, said first hook will engage with said second hook to retain said scored portion from dislodging and falling into said container.

7. A reclosable container as recited in claim 6, further comprising:

(a) said arm having a thick support portion on said hinged end adjacent said bendable forward end so that when said arm is pivoted to the extended position, said thick support portion can bear against bottom of said track of said top in front of said slide panel to give said bendable forward end proper leverage before said bendable forward end is pressed down to tear said scored portion; and (b) a finger grip formed on free edge of said bendable forward end so that said bendable forward end of said arm can be pulled up with said scored portion interconnected thereto by said first and second hooks for exposing said opening and contents of said container.

* * * * *